US005443113A

United States Patent [19]

Mulholland et al.

[11] Patent Number: 5,443,113

[45] Date of Patent: Aug. 22, 1995

[54] HEAT EXCHANGERS

[75] Inventors: Ronald Mulholland, Milton of Campsie; Donald McCallum, Cambuslang, all of Scotland

[73] Assignee: Howden Group PLC, Scotland, United Kingdom

[21] Appl. No.: 156,886

[22] Filed: Nov. 23, 1993

[30] Foreign Application Priority Data

Nov. 26, 1992 [GB] United Kingdom ..... 9224823

[51] Int. Cl.[6] ..... F23L 15/02

[52] U.S. Cl. ..... 165/8; 165/5

[58] Field of Search ..... 165/5, 6, 8, 9

[56] References Cited

U.S. PATENT DOCUMENTS

| | | | |
|---|---|---|---|
| 2,732,183 | 1/1956 | Hammond | 257/6 |
| 3,374,829 | 3/1968 | Veser et al. | 165/7 |
| 4,122,891 | 10/1978 | Baker | 165/9 |
| 4,124,063 | 11/1978 | Stockman | 165/9 |
| 4,141,754 | 2/1979 | Frauenfeld | 134/24 |
| 4,219,069 | 8/1980 | Stockman | 165/9 |
| 4,649,987 | 3/1987 | Frauenfeld et al. | 165/5 |

FOREIGN PATENT DOCUMENTS

| | | |
|---|---|---|
| 879153 | 10/1981 | Belgium . |
| 0409551 | 1/1991 | European Pat. Off. . |
| 909135 | 4/1954 | Germany . |
| 1101677 | 3/1961 | Germany . |
| 0251391 | 12/1985 | Japan . |
| 762419 | 11/1956 | United Kingdom . |
| 778758 | 7/1957 | United Kingdom . |
| 789971 | 1/1958 | United Kingdom . |
| 798108 | 7/1958 | United Kingdom . |
| 1133191 | 11/1968 | United Kingdom . |
| 2076953 | 12/1981 | United Kingdom . |
| 2112303 | 7/1983 | United Kingdom . |
| 2064084 | 6/1991 | United Kingdom . |
| WO9106819 | 5/1991 | WIPO . |

*Primary Examiner*—John Rivell
*Assistant Examiner*—Christopher Atkinson
*Attorney, Agent, or Firm*—Harness, Dickey & Pierce

[57] ABSTRACT

A Ljungstrom type heat exchanger in which the bottom sector plate is provided with welded sector plate ribs which are welded to ribs secured to the frame of the heat exchanger. The upper surface may be curved to be complementary to the thermally induced curvature of the rotor. The fairings associated with the support for the upper sector plate may be provided with ports for the passage of some hot gases to prevent distortion of the main beam. A cleaning device is disclosed in which a feed pipe is fully retractable having a nozzle at its radially outer end.

9 Claims, 4 Drawing Sheets

Fig.9 PRIOR ART
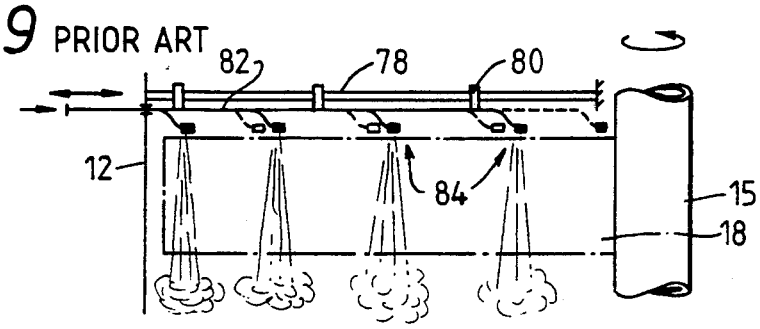
Fig.10A
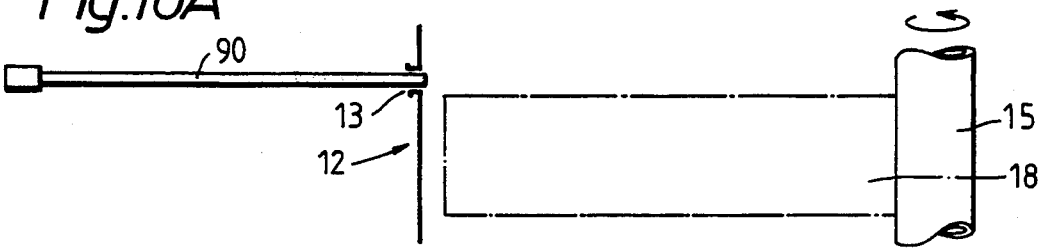
Fig.10B
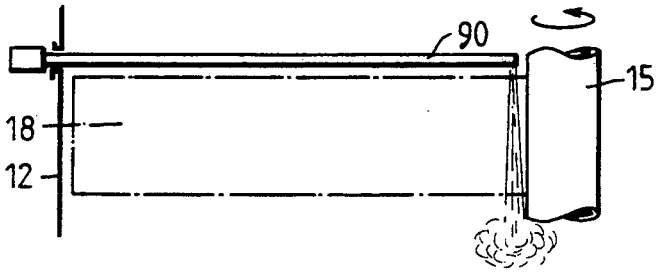
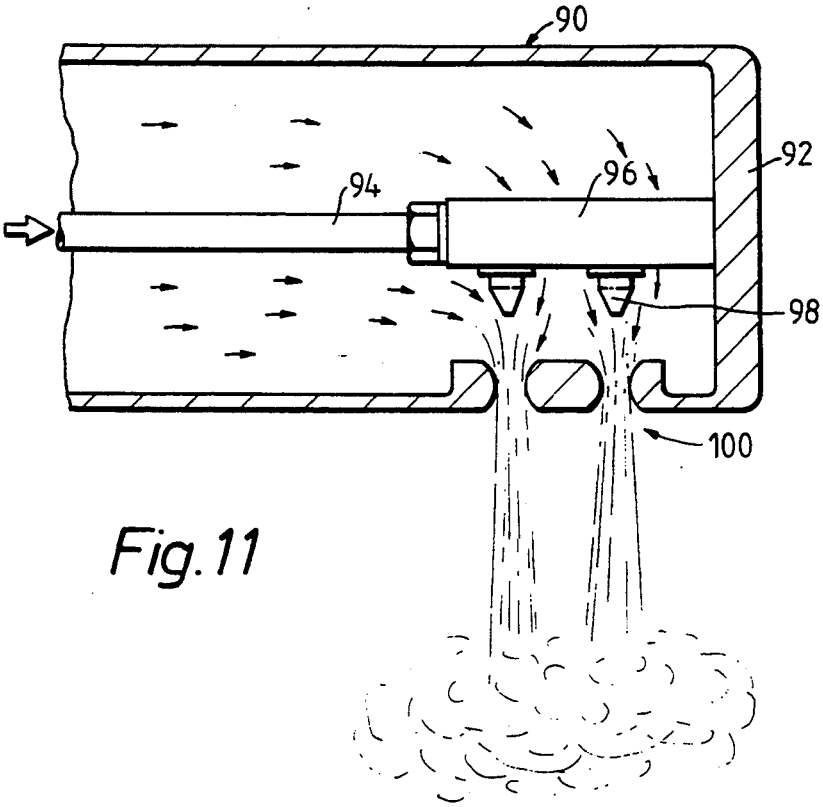
Fig.11

HEAT EXCHANGERS

The present invention relates to heat exchangers.

The invention is particularly concerned with that type of heat exchanger known as a Ljungstrom heat exchanger, These rotary heat exchangers comprise a frame, a housing carried by said frame, a rotor rotatable within said housing about an axis, a multiplicity of heat exchange elements mounted in said rotor, first and second sector plates mounted at the first and second axial ends of said rotor, said sector plates each extending along a diameter of said rotor, gas inlet and outlet ducts at said first and second axial ends respectively and arranged on the same radial side of said sector plate and air outlet and inlet ducts at said first and second axial ends respectively and arranged on the opposite radial side of said sector plates from said gas inlet and outlet ducts.

While reference has been made herein to air inlet and outlet ducts, heat exchangers of this type are also used for heat exchange between two different gases so that instead of a gas/air heat exchanger one has a gas/gas exchanger.

These heat exchangers are commonly used to recover heat for example from exhaust gases at locations such as power stations and where air is the other medium, this air is significantly heated and such pre-heated air can then be fed as combustion air to the burners of the power station.

As indicated, however, these heat exchangers can also be used in a gas/gas mode, for example in the purification of the exhaust gases to remove $NO_x$ and $SO_x$ gases. These Ljungstrom rotary heat exchangers are conventionally of a massive structure weighing several hundred tons. Of their very nature they are subjected to significant temperature gradients which can cause distortion of the rotor and some of the fixed parts, such as the sector plates. It is possible to mount the heat exchangers so that the axis of the rotor is horizontal but it is most common to mount the rotor with its axis vertical. The first and second sector plates will then be upper and lower sector plates. With such structures particular problems have been encountered with interference between the rotor and the lower sector plate upon thermal distortion.

With a view to overcoming this, it is proposed, according to the invention, for the second sector plate, at least, to be formed from a generally flat, plate material to which are welded at least two longitudinally extending sector plate ribs, which extend from the sector plate in a direction away from the rotor, and wherein support structure ribs are welded directly to the frame, said support structure ribs and said sector plate ribs being welded to each other.

With such a heat exchanger it is possible significantly to reduce the manufacturing cost because there is no necessity to machine the sector plate itself. Furthermore, the actual location of the sector plate itself can be accurately determined to ensure minimum interference with the rotor and when this position has been determined the two sets of ribs can be welded to one another. This welding produces little stress in the sector plate itself and it is for this reason that the upper surface can remain unmachined significantly reducing the manufacturing costs.

With heat exchangers of this general type, there is a significant problem of thermal deflection of the rotor during use. Conventional sector plates have had an inherent rigidity and this has meant that very often the lower sector plate has been provided with a hinged structure to allow the sector plate to be pre-set in a particular position to adapt the shape of the sector plate to that of the of the rotor after thermal movement. A resulting gap can exist between the radial seals of the rotor and the sector plate and this can give rise to unsatisfactory leakage.

It is now proposed, according to another aspect of the present invention, for the surface of the second sector plate to be constructed so as to be initially convex so that it is complementary to the concavity of the cold end of the rotor resulting from any thermal distortion. The gap between the radial seals of the rotor can thus be made minimal thereby reducing any leakage problems and making the provision of a hinged lower sector plate unnecessary.

Problems can also occur in the structure of the support for the upper sector plate. This is traditionally made from a heavy duty beam extending diametrally across the upper surface of the rotor and aerodynamic fairings are provided extending along the length of the diametral main beam. Conventionally hot gases flow downwardly over the outer surface of the fairings on the gas side before passing through the heat exchanger, There is a significant thermal gradient which tends to appear, therefore, in the main beam of the support structure associated with the upper sector plate. The lower regions of this support structure main beam are usually at a significantly higher temperature than the upper surfaces thereof. This can give rise to significant distortion.

It is thus proposed, according to a still further aspect of the invention, to provide a heat exchanger of the Ljungstrom type in which the support structure for the first sector plate comprises a main beam extending diametrally across the rotor and to one surface of which is secured the first sector plate, and aerodynamic fairings extending along the length of the main beam, wherein bleed passages are provided in the fairings to deflect a portion of the hot gases over the surfaces of the main beam effective to reduce a thermal gradient in the main beam.

Such a structure reduces the possibility of distortion of the main beam and therefore reduces the chances of distortion of the upper sector plate and therefore of leakage. Equally, feed ports can be provided in the fairing on the air side to ensure that that side of the main beam is also kept at a uniform temperature. Further improvement in the reduction in thermal distortion can be achieved if insulation is placed on the remote side of the main beam from that on which the gas and air flow. Further, it is also proposed, according to the invention, for distortion of the main beam to be reduced by arranging for hot gas to flow longitudinally of the main beam between the main beam and the fairings themselves. With such a structure, the fairing would not be provided with bleed ports, but would be provided with inlet ports at one end and outlet ports at the other end. Such hot gases would maintain a uniform temperature throughout the structure of the main beam thereby preventing thermal distortion.

All Ljungstrom heat exchangers incorporate a cleaning device, commonly known as a soot blower, which uses high pressure steam or air and sometimes also utilizes high pressure water, to clean dirty heat exchanger plates by subjecting them to high velocity jets. These structures usually employ header pipes mounted generally radially above and below the rotor of the heat exchanger and incorporate a plurality of jets which project water and/or steam and/or air against usually the surface of the heat exchanger. Provision is made for slight displacement, in a radial direction relative to the rotor, so that all parts of the rotor are struck by the jets. This operation always takes place while the rotor is rotating while the cleaning device moves slowly from one end of travel to the other providing a series of spiral cleaning paths.

A major problem associated with such a design is that any malfunction of the cleaning device which renders it inoperable will result in the heat exchanger completely fouling and so it must come "off line" that is to say it will not be operable. This could result in a complete shut-down of the system in which the heat exchanger is installed and this obviously presents considerable commercial problems.

According to a still further aspect of the invention, therefore, it is proposed to provide in a heat exchanger of this general type, a fully retractable cleaning device comprising an outer supply pipe, at least one inner water supply tube located within the outer supply pipe, means to translate the outer supply pipe and with it the or each inner supply tube generally radially of the heat exchange rotor, adjacent one axial end of the rotor, at least one water jet nozzle positioned adjacent the extreme end of the or each water supply tube and an associated opening in the outer supply pipe for the or each water jet nozzle whereby water from the or each jet nozzle may be projected outwardly through said opening and whereby a steam or air may pass outwardly through the or each opening through the rotor.

In order that the present invention may more readily be understood, the following description is given, merely by way of example, reference being made to the accompanying drawings in which:

FIG. 9 is a schematic fragmentary side elevation illustrating one form of cleaning device conventionally used for a Ljungstrom heat exchanger;

FIG. 10A and FIG. 10B are view similar to FIG. 9 showing a cleaning device installed in the heat exchanger according to the invention in a retracted and working position; and FIG. 11 is an enlarged detail of an end portion of the cleaning device of FIGS. 10A and 10B.

Figure 1:
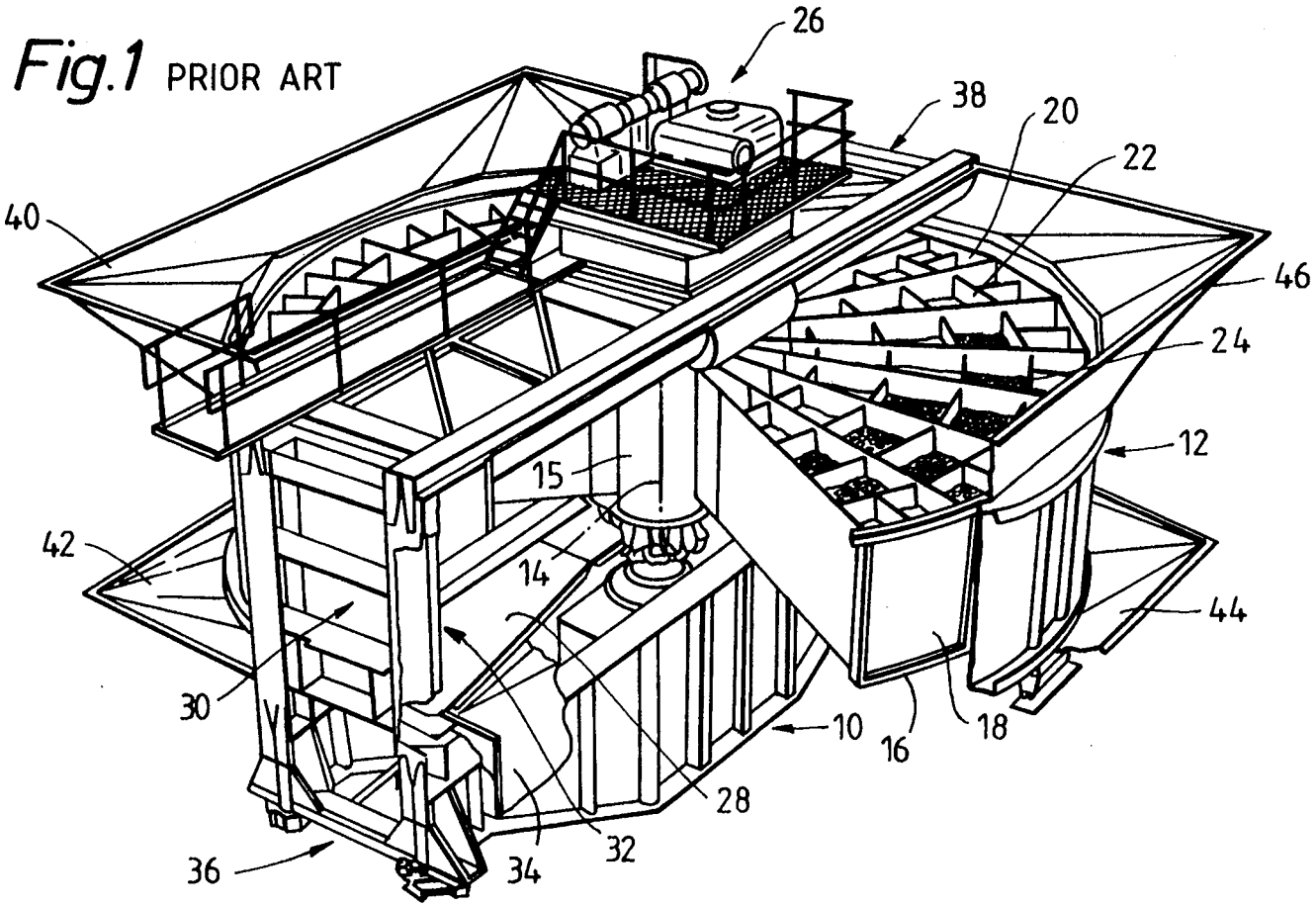
Fig.1 PRIOR ART
FIG. 1 is a schematic perspective view of a Ljungstrom heat exchanger.

Referring first to FIG. 1, there is illustrated therein a Ljungstrom type heat exchanger which includes a frame 10 upon which is mounted a housing 12 within which is rotatable, about a vertical axis 14, a rotor assembly 16 including a peripheral wall 18 connected to the hub 15 surrounding the axis 14 by a large number of radial seal plates 20. Located within the spaces between the seal plates and spacer plates 22 are a multiplicity a heat exchange elements 24. The rotor is rotatable relatively slowly, usually about one revolution per minute, about the axis 14 by a rotor drive shown schematically at 26.

The rotor drive is mounted on a diametrally extending top structure 38 to the lower surface of which is mounted a first upper sector plate, similar in structure to the second lower sector plate 28 described below, but which is not visible in the drawing of FIG. 1.

The lower or second sector plate 28 is positioned below the rotor and is in closely adjacent relationship to the lower axial end of the rotor. An end pillar 30 can be seen on which are mounted axial seal plates engaging the outer surface of the rotor 18. Secured to the frame is a bottom structure 34 upon which the lower sector plate 28 is mounted. Reference numeral 36 indicates supports which can be used for mounting the whole assembly in any suitable location. Ducting, portions of which are shown at 40,42, are provided for feeding hot gas to the far side, as viewed in FIG. 1, of the sector plates and through the rotor and for withdrawing the gas cooled by the heat exchanger respectively. Further ducts 44,46 are shown on the right of the seal plates and are used for conducting air into and out of the heat exchanger.

Such a structure is fairly standard and the concept is that hot combustion gases, for example from the furnace of a power station, are fed downwardly via the hot gas inlet duct 40 to contact the heat exchange elements 24 which are thereby heated. The somewhat cooled products of combustion exit via the outlet duct 42. At the same time cool air, to be used as combustion air for the furnace, is fed in through the duct 44 and exits via the duct 46. It passes over the heat exchange plates which are being rotated by the rotor 18 and these heat exchange plates give up their heat to the incoming air the temperature of which therefore rises. The hot air is then used as the combustion air for the furnace, this significantly improving the thermo-dynamic performance of the whole arrangement. Thus the upper end at which the first sector plate (not shown) is positioned, will be the hot end and the lower end at which the second sector plate 28 is positioned, will be the cold end of the rotor.

Figure 2:
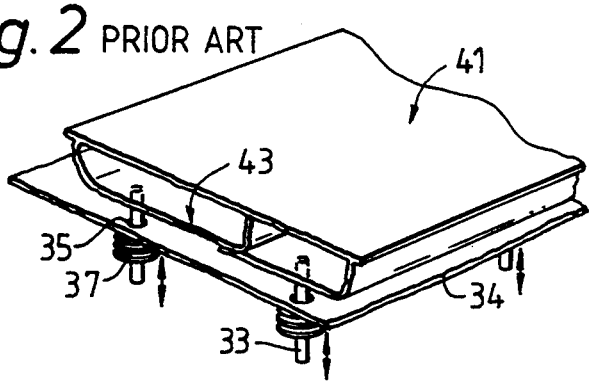
Fig. 2 PRIOR ART
FIG. 2 is a schematic perspective view of a conventional bottom sector plate of a heat exchanger as shown in FIG. 1.

If reference is now made to FIG. 2, a conventional lower sector plate 28 is illustrated. This comprises an upper sector plate member 41 to which are welded a plurality of strengthening plates 43. These are secured by independent and adjustable vertical posts 33 passing through apertures 35 in the bottom structure 34, the posts being welded the bottom of the strengthening plates 43 and are terminated at individual adjusting mechanisms. By so doing, the sector plate structure can be adjusted at any time. To prevent air or gas escaping, a seal is provided where the rod passes through the bottom structure with metallic bellows 37 utilised to provide freedom of movement. As the only means of support to the sector plate is at discrete points, the sector must rely on its "box like" structure to provide the necessary stiffness. The resulting upper surface of the plate 41 is therefore not usually very flat and it has to be machined to a flat state. The identical arrangement is repeated on the top sector plate.

Figure 3:
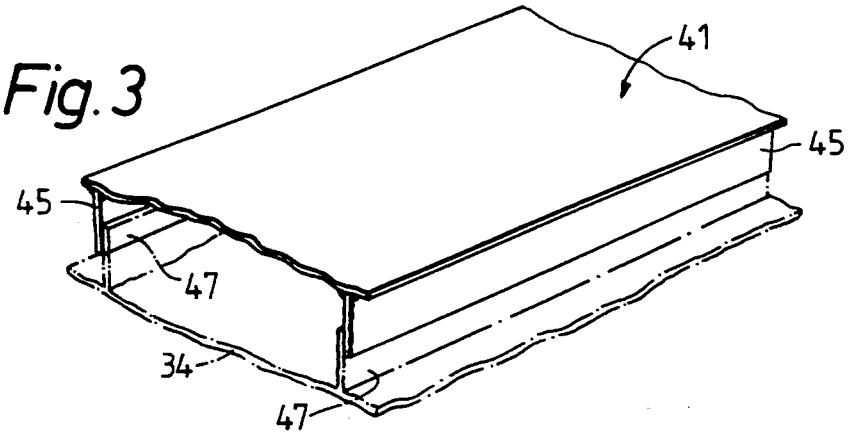
FIG. 3 is a view similar to FIG. 2 of a bottom sector plate according to the invention.

With the structure showing in FIG. 3, according to the invention, the top plate 41 has welded to its lower surface at least two longitudinally extending sector plate ribs 45. The bottom structure 34 has similar upwardly extending bottom structure ribs 47. It has been found that the ribs 45 can satisfactorily be welded to the sector plate 41 without any significant distortion thereof. With the unit thus assembled, the ribs 45 are telescoped over the ribs 47 and are welded thereto. During this mounting of the plate 41 relative to the bottom structure 34, the actual position of the plate 41 can be accurately determined before the ribs 45,47 are welded together. Such a structure thereafter needs essentially no adjustment and no machining of the top surface of the plate 41.

Figure 4:
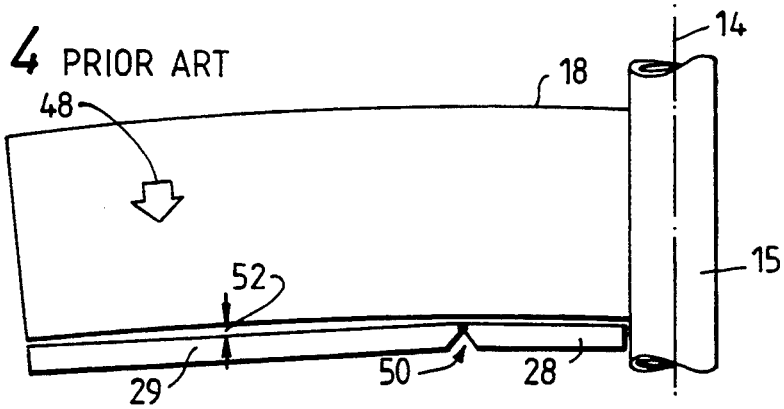
Fig. 4 PRIOR ART
FIG. 4 is a fragmentary schematic side elevation of a portion of a rotor of a known Ljungstrom heat exchanger.

As can be seen in FIG. 4, the rotor 18 of a conventional Ljungstrom heat exchanger is mounted on the hub 15 for rotation about the axis 14. Thermal effects on the rotor tend to make the peripheral portion thereof deflect downwardly as indicated by the arrow 48. In order to overcome this problem, conventionally the lower sector plate 28 is hinged at 50 to produce an outer part 29 which is deflected downwardly slightly towards the periphery of the rotor. This, however, while improving the situation and preventing rubbing of the rotor on the sector plate 28,29, nonetheless leaves a gap 52 through which gas or air can leak. This is unsatisfactory.

Figure 5:
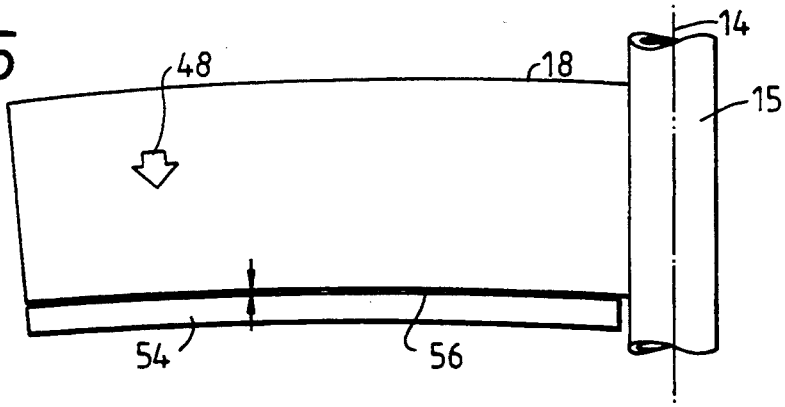
FIG. 5 is a view similar to FIG. 4 of a heating exchanger according to the invention.

FIG. 5 shows a modified structure according to the invention in which the sector plate 54 illustrated therein has an arcuate upper surface 56 which has a radius of curvature which has been estimated to match the corresponding complementary lower surface of the rotor 18 when that has been subjected to the deflection at 48. This is a simple manufacturing technique. Thus, if for example, one uses the arrangement shown in FIG. 3, then the plate 41 can be made curved during the welding on of the sector plate ribs 45 simply by supporting the plate 41 on an arcuate support table during the welding process. The arrangement shown in FIG. 3 is particularly suitable thereafter for mounting what will then be slightly curved ribs 45 to the ribs 47 connected to the bottom structure 34.

Figure 6:
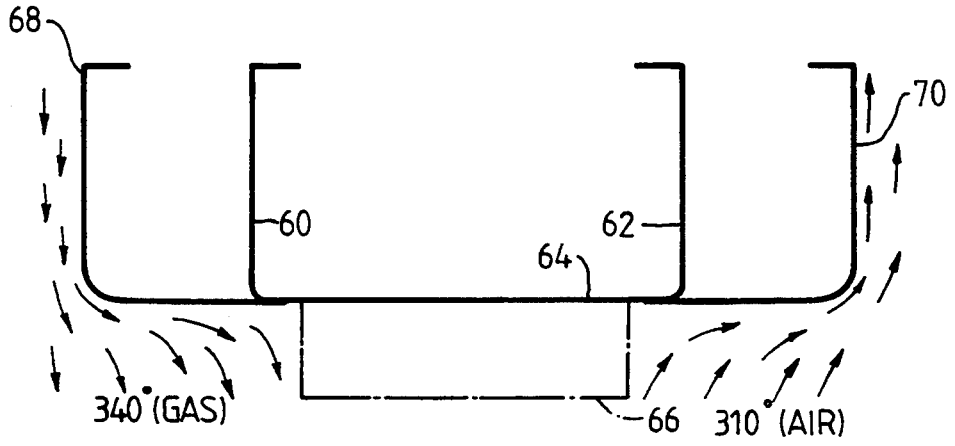
Fig.6 PRIOR ART
FIG. 6 is a schematic cross-section through the upper sector plate support of a known form of Ljungstrom heat exchanger.

If reference is now made to FIG. 6, the top support structure 38 is illustrated and is shown as comprising two relatively rigid elongate plates 60,62 and a bottom plate 64 together forming a transversely extending diametral beam to the bottom of which is secured the upper sector plate 66.

Connected to either side of the beam, that is to the left of the plate 60 and to the right of the plate 62 are fairings 68,70 which are used to guide the incoming hot gases and the outgoing heated air as indicated by the arrows. In one particular structure, as shown, the hot gas entering at a temperature of 340° C. and the heated air is at a temperature of 310° C. It will be appreciated that the hot gases raise the temperature of the fairing and thus of the lower part of the plate 60 to a temperature which is higher than that of the upper part thereof. FIG. 6 illustrates the temperature gradient between this hot lower part and the warm upper part. There is a similar, but less marked, temperature gradient associated with the plate 62. An effect of this is to distort the beam formed by the plate 60,62,64, and thereby distort the sector plate 60 producing sealing difficulties.

Figure 7:
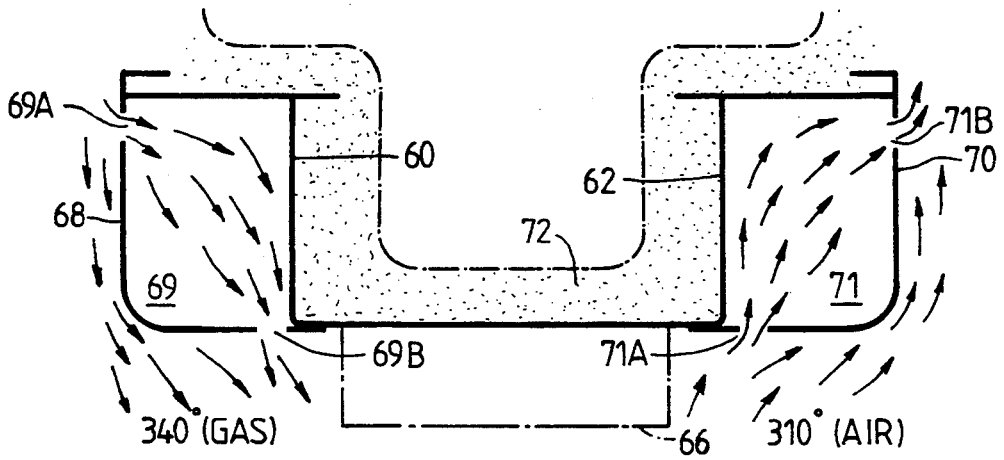
FIG. 7 is a similar view of such a support according to one embodiment of the invention.

As shown in FIG. 7, it is now proposed according to the invention to modify the fairings 68,70 so that they define internal chambers 69,71. The chamber 69 has a bleed inlet 69A and a bleed outlet 69B and the housing 71 has a lower inlet 71A and an upper outlet 71B. These bleed inlets and outlets are designed to receive a small proportion, perhaps 1%, of the hot gas and heated air flowing over the fairing and to introduce them into the interior of the chambers 69,71. It has been found that this tends to equalize the temperature of the plates 60,62 so that the tendency for them to deform is very much reduced. This effect can be increased further by providing insulation 72 within the beam as shown in chain dotted lines.

Figure 8:
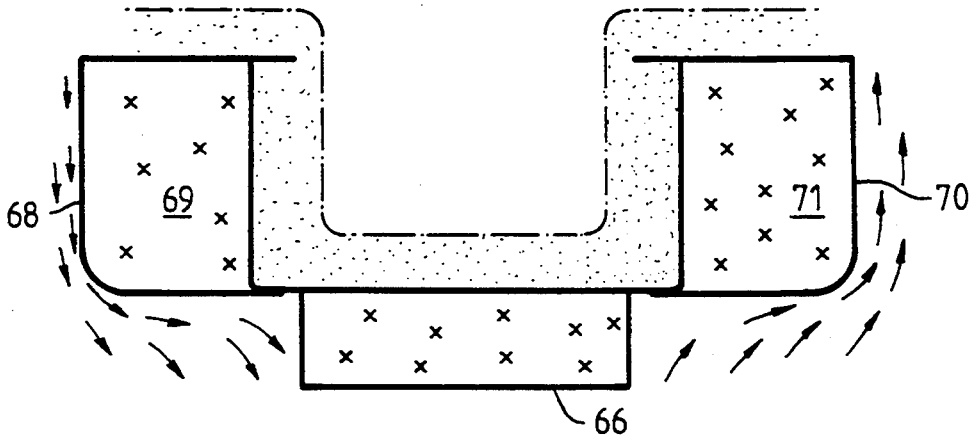
FIG. 8 is a view similar to FIG. 7 of a somewhat modified version.

Another approach is that shown in FIG. 8 in which like parts have been indicated by like reference numerals. However, in this structure, instead of there being bleed passages 69A,69B,71A,71B, there are inlets and outlets (not shown) at the ends of the chambers 69,71. Hot gas can be caused to flow through these chambers, from one end to the other and this again equalizes the temperature arrangement. Hot gases can also be supplied through hollow portions of the upper sector plate 66 for the same purpose.

Heat exchangers of this type need regular cleaning, particularly when they are handling hot flue gases because these tend to deposit soot on the plates of the heat exchanger. A conventional type of cleaner, referred to in the trade as a "Soot Blower" is illustrated in FIG. 9. A guide beam 78 is provided with several hangers 80 along which is slidable from the position indicated in full lines to the position indicated in dotted lines, a supply pipe 82 having several nozzles 84 spaced along the length. A supply pipe 82 can be reciprocated a small amount as indicated in full line and in dotted line and high pressure steam or air, and sometimes high pressure water, are projected downwardly as illustrated schematically through the rotor 18. The rotor is caused to rotate, and the nozzles, as they move inwardly towards the hub 15 can produce several spiral paths from these nozzles. In this way the soot of the whole rotor 18 can be cleaned out.

As explained earlier, this has a number of disadvantages. The structure according to the invention is illustrated in FIGS. 10A and 10B in which again a rotor 18 is shown rotatable on hub 15 in the same manner. In this instance, instead of having a supply pipe with a plurality of longitudinally spaced nozzles 84, here a supply pipe 90 is movable from the fully retracted position illustrated in FIG. 10A to a fully engaged position illustrated in FIG. 10B and has one or more nozzles at or adjacent the inner end, that is to say the end nearer the hub 15. In use, again high pressure water and high pressure air can be selectively projected downwardly by the single nozzle or nozzles adjacent the end of the supply pipe 90 which can be moved steadily outwardly and indeed can be reciprocated to the desired extent. However, when the cleaning operation has been completed, the whole supply pipe 90 is removed or positioned as shown in FIG. 10A so that the inner end is only just engaged in an opening 13 in the housing 12 of the rotor. When in the retracted position of FIG. 10A the cleaning arrangement or soot blower can be checked to make sure that it is operating fully satisfactorily and this avoids the problems which have hitherto occurred where the nozzles have become clogged or do not work properly so that the heat exchanger can become completely fouled with soot, therefore putting the heat exchanger out of use and perhaps requiring a whole shut-down of the furnace associated with the heat exchanger.

A particular construction of the soot blower of FIGS. 10A and 10B is illustrated in somewhat more detail in FIG. 11. It will be seen that the supply tube 90 is closed at the end 92 and has associated therewith a co-axial water pipe 94 opening into a manifold 96 in which a number of nozzles 98 are located. As shown, two such nozzles are illustrated. However, in practice it is contemplated that several pairs should be provided thus giving, for example, six nozzles 98, the two other pairs being behind those shown in FIG. 11. Associated with each nozzle 98 is an air nozzle 100 through which air can be supplied through the interior of the supply pipe 90. Very satisfactory results have been found to be achieved with this device when air is supplied at six to ten atmospheres and the water at a suitable high pressure. It will be appreciated that the nozzles 98 and 100 can fully clean out the whole of the heat exchange elements located in the rotor 18 and yet the whole cleaning device can be removed for inspection and so that it itself not being subjected to heat and corrosive environment constantly as has been the case with prior constructions.

All of the above structures have been described as having the first, hot end of the rotor at the top and the second, cold end at the bottom. It will be appreciated that the first, hot end could equally be at the bottom. Similarly, the rotor could be mounted with the axis other than vertical, e.g. it could be horizontal, with the sector plates then being located to one side and the other, respectively.

We claim:

1. A heat exchanger comprising a frame, a housing carried by said frame, a rotor rotatable within said housing about an axis, said rotor having first and second axial ends, a multiplicity of heat exchange elements mounted in said rotor, first and second sector plates mounted at the first and second axial ends of said rotor, the first axial end being the hot end and the second axial end being the cold end of the rotor, said sector plates each extending along a diameter of said rotor, gas inlet and outlet ducts at said first and second axial ends respectively and arranged on the same radial side of said sector plate and air outlet and inlet ducts at said first and second axial ends respectively and arranged on the opposite radial side of said sector plates from said gas inlet and outlet ducts, said second sector plate, being formed from a generally flat, plate material, at least two longitudinally extending sector plate ribs, welded to said plate material and extending from the sector plate in a direction away from the rotor and support structure ribs welded directly to the frame, said support structure ribs and said sector plate ribs being welded to each other.

2. A heat exchanger as claimed in claim 1, wherein the surface of the second sector plate adjacent the rotor is unmachined.

3. A heat exchanger as claimed in claim 2, wherein the surface of the sector plate adjacent the rotor is made convex, so that it is complementary to the concavity of the rotor which may result from any thermal distortion.

4. A heat exchanger as claimed in claim 1, wherein the first sector plate is mounted on a main beam extending diametrally across the rotor, aerodynamic fairings extending along the length of the main beam and bleed passages are provided in the fairings to deflect a portion of the hot gases over the surfaces of the main beam, effective to reduce any thermal gradient in the main beam.

5. A heat exchanger as claimed in claim 1, and further comprising a support structure including a main beam extending diametrally across the rotor and to one surface of which is secured the first sector plate, aerodynamic fairings extending along the length of the main beam, thereby to provide chambers within the beam, inlet and outlet ports at opposite ends of said chambers and means to feed hot gases longitudinally of said chambers.

6. A heat exchanger as claimed in claim 1, wherein a fully retractable cleaning device is provided, comprising an outer supply pipe, at least one inner water supply tube located within the outer supply pipe, means to translate the outer supply pipe and with it the or each inner supply tube generally radially of the heat exchange rotor, adjacent one axial end of the rotor, at least one water jet nozzle positioned adjacent the extreme end of the or each water supply tube and an associated opening in the outer supply pipe for the or each water jet nozzle whereby water from the or each jet nozzle may be projected outwardly through said opening and whereby a steam or air may pass outwardly through the or each opening through the rotor.

7. A rotor heat exchanger comprising a frame, a housing carried by said frame, a rotor rotatable within said housing about an axis, said rotor having first and second axial ends, a multiplicity of heat exchange elements mounted in said rotor, first and second sector plates mounted at the first and second axial ends of said rotor, the first axial end being the hot end and the second axial end being the cold end of the rotor, said sector plates each extending along a diameter of said rotor, gas inlet and outlet ducts at said first and second axial ends respectively and arranged on the same radial side of said sector plate and air outlet and inlet ducts at said first and second axial ends respectively and arranged on the opposite radial side of said sector plates from said gas inlet and outlet ducts, wherein the surface of the second sector plate adjacent the rotor is constructed so as to be initially convex, so that it is complementary to the concavity of the cold end of the rotor resulting from any thermal distortion.

8. A rotary heat exchanger comprising a frame, a housing carried by said frame, a rotor rotatable within said housing about an axis, said rotor having first and second axial ends, a multiplicity of heat exchange elements mounted in said rotor, first and second sector plates mounted at the first and second axial ends of said rotor, the first axial end being the hot end and the second axial end being the cold end of the rotor, said sector plates each extending along a diameter of said rotor, gas inlet and outlet ducts at said first and second axial ends respectively and arranged on the same radial side of said sector plates and air outlet and inlet ducts at said first and second axial ends respectively and arranged on the opposite radial side of said sector plates from said gas inlet and outlet ducts, a structure for the first sector plate comprises a main beam extending diametrally across the rotor and to one surface of which is secured the first sector plate, aerodynamic fairings extending along the length of the main beam, and bleed passages provided in the fairings to deflect a portion of the hot gases over the surfaces of the main beam effective to reduce any thermal gradient in the main beam.

9. A rotary heat exchanger comprising a frame, a housing carried by said frame, a rotor rotatable within said housing about an axis, said rotor having first and second axial ends, a multiplicity of heat exchange elements mounted in said rotor, the first axial end being the hot end and the second axial end being the cold end of said rotor, first and second sector plates mounted at the first and second axial ends of said rotor, said sector plates each extending along a diameter of said rotor, gas inlet and outlet ducts at said first and second axial ends respectively and arranged on the same radial side of said sector plate and air outlet and inlet ducts at said first and second axial ends respectively and arranged on the opposite radial side of said sector plates from said gas inlet and outlet ducts, a first sector plate support comprises a main beam extending diametrally across the rotor and to one surface of which is secured the first sector plate, aerodynamic fairings extending along the length of the main beam, the fairings and the main beam providing elongate chambers, and inlet and outlet ports connected to means to feed hot gases longitudinally through said chambers.

* * * * *